US006969464B1

(12) United States Patent
Potts

(10) Patent No.: US 6,969,464 B1
(45) **Date of Patent: *Nov. 29, 2005**

(54) DEWATERING A LEACH FIELD

(76) Inventor: David A. Potts, 385 Roast Meat Hill Rd., Killingworth, CT (US) 06419

( * ) Notice: Subject to any disclaimer, the term of this patent is extended or adjusted under 35 U.S.C. 154(b) by 214 days.

This patent is subject to a terminal disclaimer.

(21) Appl. No.: 10/053,311

(22) Filed: Jan. 17, 2002

Related U.S. Application Data

(60) Provisional application No. 60/262,696, filed on Jan. 17, 2001.

(51) Int. Cl.[7] ..... C02F 3/00
(52) U.S. Cl. ..... 210/605; 210/747; 210/617; 210/620; 405/36; 405/43
(58) Field of Search ..... 405/36, 43, 50, 405/128.25, 128.3; 210/616, 615, 605, 617, 210/747, 620

(56) References Cited

U.S. PATENT DOCUMENTS

| | | | | | |
|---|---|---|---|---|---|
| 4,429,647 | A | * | 2/1984 | Zinck | 111/118 |
| 5,200,065 | A | * | 4/1993 | Sinclair et al. | 210/104 |
| 5,202,027 | A | * | 4/1993 | Stuth | 210/615 |
| 5,383,974 | A | * | 1/1995 | Johnson | 134/21 |
| 5,588,777 | A | * | 12/1996 | Laak | 405/40 |
| 5,810,514 | A | * | 9/1998 | Suchecki, Jr. | 405/128.5 |
| 5,827,010 | A | * | 10/1998 | Hassett | 405/36 |
| 6,018,909 | A | * | 2/2000 | Potts | 47/58.1 R |
| 6,485,647 | B1 | * | 11/2002 | Potts | 210/616 |
| 2003/0173293 | A1 | * | 9/2003 | Potts | 210/616 |
| 2004/0195177 | A1 | * | 10/2004 | Potts | 210/620 |

FOREIGN PATENT DOCUMENTS

| | | | | |
|---|---|---|---|---|
| WO | WO 9713593 | * | 4/1997 | B09C 1/00 |
| WO | WO 9965573 | * | 12/1999 | A62D 3/00 |

OTHER PUBLICATIONS

"How Does Terralift 2000 Work?" undated, from www.terralift2000.com/homeowners/howitworks.html, 2 pages.*

"Design Manual—Subsurface Sewage Disposal Systems" p. 89-91, State of Connecticut Department of Public Health (Jul. 1998).

* cited by examiner

*Primary Examiner*—Robert J. Sandy
*Assistant Examiner*—Katherine Mitchell
(74) *Attorney, Agent, or Firm*—Michael A. Blake

(57) ABSTRACT

A leach field of a sewage system is dewatered, to restore its function when it is at or near failure. In various embodiments, water is withdrawn from the points in the leach field, preferably from the conduits, by means of suction or sub-atmospheric pressure. As water is drawn from the soil, air from the atmosphere or from an air mover enters resultant spaces in the soil, to restore the influence zone and better treat waste water. Forced air flow is used to fissure the soil, to aid dewatering, and separately, to restore the leach field.

4 Claims, 3 Drawing Sheets

DEWATERING A LEACH FIELD

This application claims benefit of provisional patent application Ser. No. 60/262,696, filed Jan. 17, 2001.

TECHNICAL FIELD

The present invention relates to subsurface waste water disposal, in particular to the treatment of waste water a leach field.

BACKGROUND

In a waste water treatment system of the type commonly used for domestic dwellings and other limited volume waste water sources, waste water is flowed first into a buried septic tank where it is acted upon by microorganisms in an anaerobic environment. Waste water effluent from the septic tank is typically flowed into a secondary treatment system element, so it can be acted upon by other microorganisms in an aerobic environment. It is thereby made relatively environmentally benign, so it can flow to ground water or surface water. Most commonly, the waste water will be flowed into a leach field for treatment. A leach field is comprised of one or more lengths of conduit which are buried beneath the surface of the earth. Traditional types of leach fields are comprised of a perforated pipe, or a series of concrete galleries, buried in a stone or gravel filled trench, and overlaid by soil. Less common and less preferred is a leach pit. More recently, leach fields are comprised of arch shaped plastic chamber conduits. As mentioned in the following Description, there are many other kinds of leach field conduits.

The soil adjacent the conduit comprises a region called the influence zone, where waste water from the conduit is biochemically acted upon. Water thereafter flows sideways and mostly downwardly toward the water table of the local earth, and to a certain degree upwardly, in part due to transpiration and plant uptake.

The present invention is generally applicable to situations where the leach field is incapable of accepting or of sufficiently treating the quantity of waste water delivered to it. In common modes of leach field failure, insufficiently treated waste water percolates to the surface of the soil; or it flows from the earth at the side of a slope; or it flows with insufficient treatment into ground water; or the waste water system fails to accept further waste water and it "backs up" at the source. Failure is commonly ascertained visually, by odor, or by a water test that too many pollutants and bacterial contamination.

In a prior invention, referred to in more detail below, air is caused to flow through a leach field, in particular the influence zone, and the result is an increase in the effectiveness of the waste water system of which it is a part. However, it is not uncommon that a failure of a leach field is gross in the sense that waste water from below has appeared on the soil surface, and that there is a refusal of the system to accept normal flow of waste water. For such situations, there would be a benefit in making the prior invention quicker and easier to apply.

SUMMARY

An object of the invention is to improve or restore the extent of waste water processing within a leach field of a waste water system. Another object is to increase biochemical activity within the influence zone of a leach field system.

A still further object is to facilitate the introduction of air into the conduit and influence zone of a leach field.

In accord with the invention, the leach field of a waste water system is dewatered, to physically remove water. The invention is useful for leach fields which have failed, and which have become nearly or fully saturated with water. In the invention, water is caused to flow to one or more points within the leach field, and water is removed from the point(s), and preferably discharged to some place away from the leach field. In one embodiment, water is drawn from the conduit of the leach field. Withdrawing sufficient water from the conduit by pump suction or by applying sub-atmospheric pressure induces water in the influence zone to flow into the conduit, from which it is continuously or intermittently removed. When the water is simply pumped from the conduits, natural forces cause flow of water into the conduits. When the conduits are subjected to sub-atmospheric pressure, the differential pressure with atmosphere causes greater flow of water. In another embodiment of the invention, cavities are excavated in the surface of the soil or collection pipes are inserted in the soil of the leach field and water is removed therefrom.

In accord with the invention, drawing waste water causes it to be replaced by diffusion of air from the atmosphere. The related invention is then preferably applied to the soil, wherein air is forced into the soil by pressurizing the interior of conduit. Use of the present invention lowers resistance to such air flow and air flows through the influence zone and field more easily and quickly than otherwise.

In preferred embodiments of the invention, the withdrawal of water is alternated with the application of air pressure; a water impermeable membrane is placed over the surface of the soil above the conduit, to better direct the flow of atmospheric air through the soil to replace water which is being removed. In another preferred practice of the invention, the leach field comprises a waste water system which includes a septic tank; and, the septic tank is partially or fully emptied, to cause flow-back and partial emptying of the conduits; or, to provide a region for receiving continuing waste water flow, so the time in which air remains in the soil without new waste water is increased.

In a further embodiment of the invention, a known process is used for creating fissures in the soil, to enable drainage of water to remote points. In the known process, air is injected through pipes inserted in the soil surface, leaving holes when they are removed. In the invention, the holes are sealed shortly after the creating of the fissures, to thereby induce more favorable natural flow of air through the soil, and avoid preferential air flow through the holes when air is later forcibly flowed into the influence zone.

The foregoing and other objects, features and advantages of the present invention will become more apparent from the following description of preferred embodiments and accompanying drawings.

DESCRIPTION

The present invention may be used in combination with the invention of the related U.S. Pat. No. 6,485,647, Method and Apparatus for Treating Leach Fields. In the related invention, air or other reactive gas is flowed through the influence zone of a leach field conduit, to beneficially affect the biochemical activity in the influence zone. Various methods and apparatuses for causing air to flow through the influence zone are described. The prior invention is referred to here as Leaching Field Aeration, or LFA. The description and drawings of the LFA Patent Ser. No. 6,485,647 are hereby incorporated by reference.

The present invention is intended for use with a waste water system that has failed during use, or that exhibits diminished capacity, and that is thus in need of treatment, for improvement or restoration. In undertaking the treatment, one may desire to combine the present invention with use of the LFA invention or other techniques, to produce a greater or quicker result.

In a normally functioning leach field, conventional thinking is that predominantly there is aerobic treatment of the waste water in the influence zone. Thus, in many failures it is found that there has been or is insufficient oxygen, to satisfy or reduce the Oxygen Demand of the waste water. The term "Oxygen Demand" is a characterization of how much oxygen is needed to effectively treat the oxidizable constituents of a substance, e.g., waste water, to make the substance relatively environmentally benign. Oxygen Demand is usually divided into two constituents, namely Biological Oxygen Demand (BOD) and Chemical Oxygen Demand (COD). For waste water systems associated with habitations, BOD is a commonly measured parameter of interest. It is measured in accord with United States Environmental Protection Agency Standard 405.1. The so-called Hach Method 8000 is one way to measure COD. Dissolved oxygen in waste water of a leach field may be measured, to infer Oxygen Demand, which is inverse to the amount of dissolved oxygen, by means of commercial devices.

Figure 1:
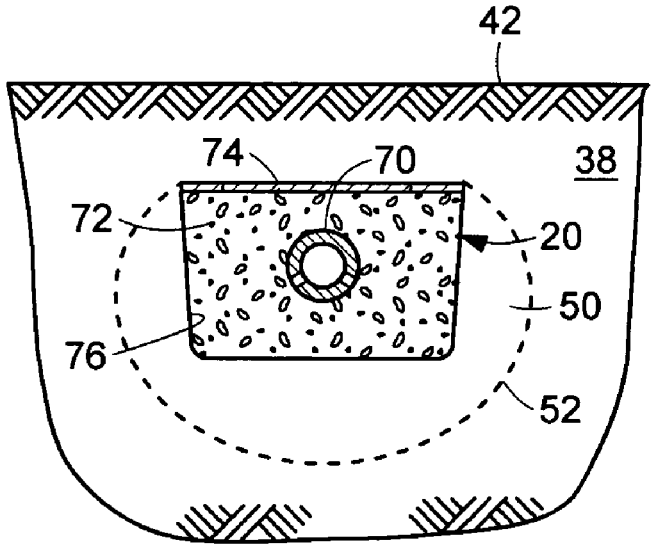
FIG. 1 is a vertical plane cross section through a leaching conduit in soil, namely a pipe in a stone filled trench.
Figure 4:
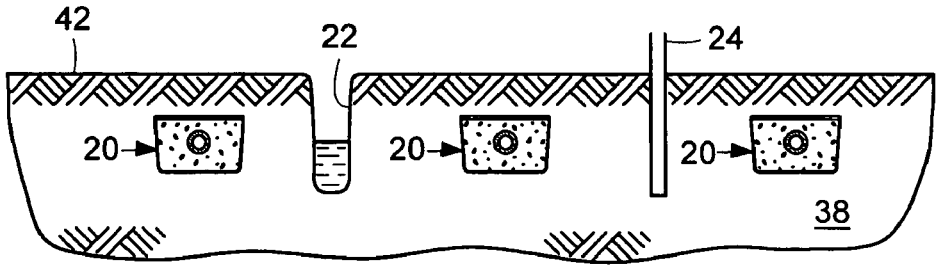
FIG. 4 is like FIG. 3, showing multiple conduits, along with two different ways of removing water from vicinity of the conduits.

FIG. 4 shows the parts of a typical septic type waste water system and is discussed further below. Primary waste water treatment, predominantly anaerobic, takes place in the septic tank 30; and, secondary treatment, predominately aerobic, takes place in the leach field, downstream of the septic tank. FIG. 1 shows a vertical plane cross section through a conduit 20 in soil 38. It comprises a construction that has been long used in the art. Perforated pipe 70 runs along trench 76 which is filled with gravel or pea stone 74. The trench has an overlying permeable filter fabric 74, to protect the stone from soil infiltration. The assembly comprising the pipe and stone filled trench are considered here to comprise conduit 20. The influence zone 50 has a nominal outer boundary 52. The influence zone is the region where, in a properly functioning waste water system, the waste water is biochemically converted into a more environmentally benign form, prior to flowing into the ground water or other place of discharge. The geometric definition of any particular influence zone is somewhat indefinite and changeable with time and system functioning. In the drawings here, the outer boundary 52 is imaginary and not intended to represent any limiting dimension or proportion. In the literature, reference is often made to a bio-mat, or the layer of concentrated organic material, usually found right next to the conduit. The bio-mat is part of the influence zone; and, in some cases where the biomat has become almost impermeable, it may comprise the preponderance of the influence zone, albeit minimally functional.

Figure 2:
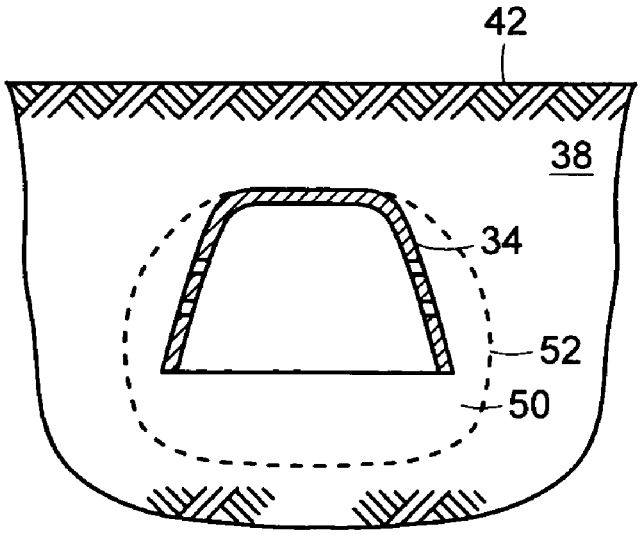
FIG. 2 is like FIG. 1, showing an arch shape chamber conduit.

FIG. 2 is analogous to FIG. 1. It shows a more modern leach field element, comprised of a perforated side wall leaching chamber 34, such as an Infiltrator® high capacity leaching chamber (Infiltrator Systems, Inc., Old Saybrook, Conn., US). In the generality of the present invention, a space in the soil, which enables the wastewater to be delivered to an influence zone is generally considered as the conduit. Thus, for purposes of this description, the pea stone or gravel media which fills the trench and surrounds the perforated pipe in the pipe and trench system illustrated in FIG. 1 is here considered to comprise the interior of a conduit, as does the hollow interior of a chamber. It is commonly understood that the spaces amongst the stone or gravel of the media in the trench are a means of holding and delivering waste water within and along the trench, to the influence zone of the soil. This is so, even though in some instances, some waste water treatment may take place within such media. Thus, the chamber 34 and stone filled trench 20 are similar with respect to this invention description and the term conduit. Still other devices comprise conduits. There are many ways of constructing leach fields, using traditional and modern day style devices. Thus, for purposes of the claimed invention, such other devices as exist now and in the future will be considered conduits when they operate analogously to the devices shown in FIGS. 1 and 2 in at least delivering waste water to an influence zone. This is so irrespective of whether they may also serve another function, such as cesspools do. Other conduits include but are not limited to galleries, leach pits (dry wells), cesspools, galleries, and the like: and, proprietary systems sold in commerce, such as corrugated leaching systems covered with filter fabric, so called in-drain leaching units, fins, and living filters, and so forth.

A leach field is often comprised of a multiplicity of interconnected conduits. For instance, separate strings of chambers, and lengths of trenches having perforated pipes, are often installed as parallel-running laterals or branches, extending from a distribution box or header. Thus, a reference to a conduit should be construed to be a reference to one or a multiplicity of conduits (chambers, trenches, etc.); and an action with respect to a conduit, such as removing water or applying air, is often accomplished by connecting to a pipeline or distribution box or other piece of apparatus which is in communication with the conduit.

In a typical leach field, atmospheric air is the usual source of oxygen for waste water treatment in the influence zone of the soil. Air diffuses or convects from the surface and through the depths of native soil, within the vadose zone, that is the portion of normally and naturally unsaturated soil that lies above any water table. A properly installed leach field is positioned within the vadose zone. However, when the soil in which the leach field is installed becomes saturated with water, the transport of air, or any other gas carrying an oxidizer, is inhibited. Thus, soil that is or has been saturated for a time can have an accumulation of organic material and a large latent Oxygen Demand. If it is possible to cease use of the waste water system for an extended period of time—perhaps years, natural drainage and aeration will tend to remedy the situation. In most instances, that will not be practical.

Most people want to continue existing use of a leaching system. Thus, when there is a problem they seek a quick remedy. They also may want to use the LFA invention in which air or other active gas is flowed through the influence zone. But, when soil is saturated with waste water, it is resistant to passage of air. Thus, even though sufficient LFA air pressure and time can push water from the influence zone, dewatering of the influence zone in accord with the present invention makes LFA easier and quicker. Similarly, quicker benefit can obtained when another alternative is pursued, such as by flowing some reactive substance, such as an oxidizer or alkali into the influence zone.

Figure 3:
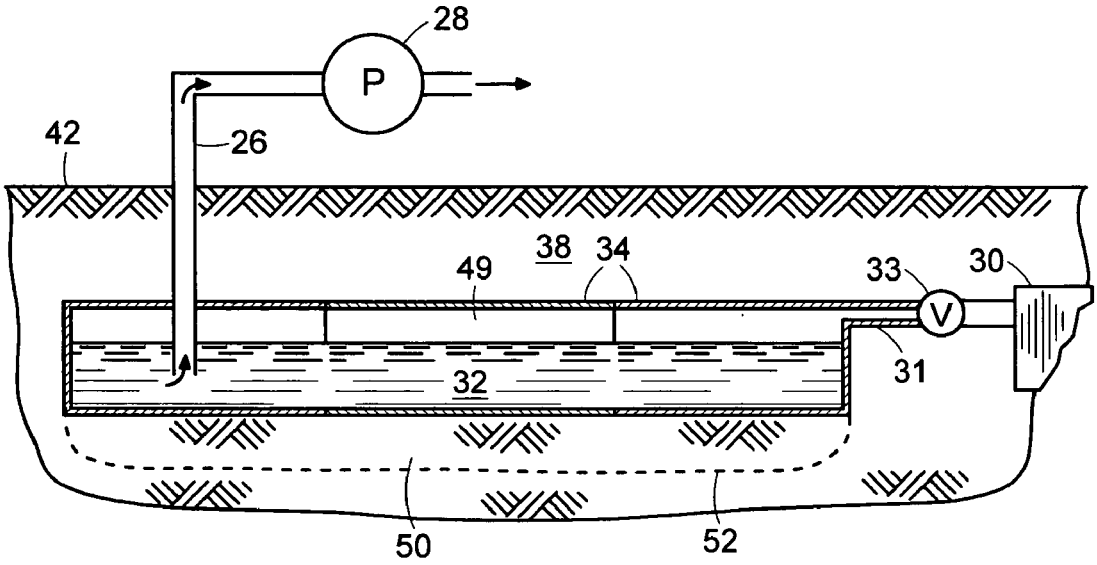
FIG. 3 is a centerline cross section through a conduit comprised of a string of chambers buried in the soil, with a connecting septic tank water source, and with a connecting dewatering pump.

FIG. 3 illustrates one embodiment of the invention. FIG. 3 is a vertical plane, lengthwise, section through the earth, showing a conduit running from a septic tank. Distribution line 31 carries waste water from septic tank 30 to the leaching system conduit comprised of a series of chambers 34. Pump 28 is connected to the conduit interior by suction pipe 26. Water 32 in the conduit flows as indicated by the arrows to the pump, and it is discharged to an unshown tank or otherwise conveyed away from the leach field vicinity in an environmentally acceptable way. When sucking water from conduits by means of a pump, the suction pipe may be inserted into the conduit in any convenient way. For instance, it may be inserted by penetrating through the distribution line 31; and, it may be only partially immersed in the waste water so that a mixture of air and entrained water is sucked from the conduit.

In one alternative mode, water is simply pumped out of the conduits at a rate greater than any continuous inflow of waste water down line 31. More preferably, use of the waste water system is temporarily ceased; or the septic tank is partially or fully emptied, as described below; or, the line 31 is closed off by means of optional valve 33 or some temporary means.

In another alternative mode, the conduit is evacuated so the interior is at sub-atmospheric pressure. For instance, pump 28 is replaced by a vacuum pump system, of the type common for trucks that pull waste water from septic tanks during routine maintenance. Preferably, a good seal is made between the suction pipe 26 and the conduit or distribution line 31 or other device connected to the conduit. Less preferably the volume of the vacuum pump system is sufficient to overcome leakage. Since a septic tank is typically connected to a vent pipe, it is necessary to block off line 31 at an appropriate point.

In any mode of removing water, water 32 that resides in the conduit is removed first. With continued removal, water flows from the influence zone 50 and from adjacent soil regions into the conduit, in the reverse direction that characterizes normal operation of the waste water system. As the water is withdrawn from the influence zone soil or adjacent soil, the water in the soil will be replaced by atmospheric air that infiltrates the soil from the soil surface 42.

In most failed systems, the conduits are saturated, or filled, with waste water. Thus, the simple step of pumping the conduits is beneficial, even if water does not much flow out of the influence zone, such as because the flow is impeded by a heavy bio-mat layer. The reason is that even in partially dewatered conduits, air can flow along the space 49 above the water in the conduits, compared to their being filled with water, and the LFA would thus benefit. Most often and preferably, the withdrawal of water from the conduit is sufficient to induce flow of water from the influence zone into the conduits, due to gravity and surface tension. Of course, when the conduit is evacuated to sub-atmospheric pressure, the pressure differential relative to atmosphere causes atmospheric air to aid the flow of water from and through the influence zone and into the conduit. In the invention, the emptying of the conduit will be continued intermittently or continuously, to enable as much dewatering of the influence zone as possible.

Of course, how much the entirety of the influence zone could drain depends on the extent to which the water level in the conduit can be lowered. Obviously, even when sub-atmospheric pressure is applied, the dewatering of the influence zone at the bottom of the conduit will be less than the dewatering of the portion above the reduced conduit water elevation. There can be some effect on the lower elevation regions of the influence zone, since the overlying "load" of water is removed, and occurrence of some natural drainage can be presumed. However, it is also the case that beneficial natural infiltration of air is easier the closer the influence zone is to the surface. In practice, draining of conduits to the extent possible, even when partial, creates a beneficial result in the influence zone and thus enables restoration of leach fields.

In another embodiment of the invention, water is first removed from a conduit by suction, or by applying sub-atmospheric pressure, as described just above. Then the process is stopped and pressure is applied to the conduits, to force a gas, which may or may not be air or other active gas, into the leach field, for the purpose of physically causing motion of contained water and possibly of the soil itself. The gas pressure application is then ceased, and natural drainage is allowed to recur. Or, the conduits are subjected to low pressure again, whereupon the water accumulates again in the conduits from which it is withdrawn.

Obviously, when the influence zone is drained, water will more than likely flow from the surrounding soil, into the influence zone, until the soil in the leach field vicinity is generally drained, should the dewatering be continued for sufficient duration. However, dewatering does not have to be continued to such extreme to make the invention useful. If the flow of water through the soil is relatively poor, draining the conduits and the influence zone will create a water gradient within the soil. The gradient will slope downwardly in the direction of the conduit, to the elevation to which it was possible to lower water level within the conduit. Over time such a gradient is eliminated by natural forces. However, until that happens, air will necessarily have been drawn into the spaces within the soil which were emptied by the dewatering. This is in itself beneficial. (Generation of gaseous decomposition by-products within the soil is considered inconsequential in the context of a typical short time of minutes or hours during which the dewatering typically occurs.) And when the LFA invention is used, as it most often will be, pressurization of the conduit will forcibly flow air into the influence zone, inhibiting the migration of water from remote higher water gradient areas.

In another embodiment of the invention, illustrated by FIG. 4, excess wastewater in the leach field is removed by excavating one or more cavities 22 in the surface of the soil of the leach field, preferably away from the influence zone, but alternately within it. Water then flows by gravity and other natural phenomena from vicinity of the conduits 20 and their associated influence zones, to the holes. It is pumped from the holes to a tank or discharge point, not shown, for disposal. Sometimes the terrain will permit the holes to be long trenches, which can be drained by gravity. However, it is generally undesired to use this embodiment since digging holes in the leach field creates a disturbance and nuisance. So, alternately, pipes 24, such as well points and the like, are inserted vertically (and perhaps laterally, when the terrain permits) within the soil near the leach field, as also shown in FIG. 4, to achieve the same result. Such pipes have lower ends that are water permeable. For instance, they have holes or slots. Alternatively, sub-atmospheric pressure, rather than ordinary pump suction, is applied to the pipe.

In another embodiment of the invention, the leach field is configured in a certain less common way, so that when the septic tank is partially emptied, a conduit which is connected to the septic tank and is filled with water at least partially drains back into the tank. Thus, with this kind of system, when the septic tank is partially or fully emptied, there is dewatering of the conduit, in the same way as achieved by directly pumping of a conduit.

When a waste water system is in continuing use, and it is desired to dewater the conduits and influence zone, the septic tank is partially or fully emptied, prior to or contemporaneously with removal of water from the conduits. That action provides an accumulation zone or reservoir for subsequent waste water flow into the septic tank. Thus, as the use of the waste water system continues, there will be a longer time before which wastewater re-flows into the dewatered conduits and influence zone. This increases the time during which biochemical action can be effected by air in the influence zone, whether the air is present or simply due to natural processes or whether it is being forcibly flowed through the zone.

Figure 5:
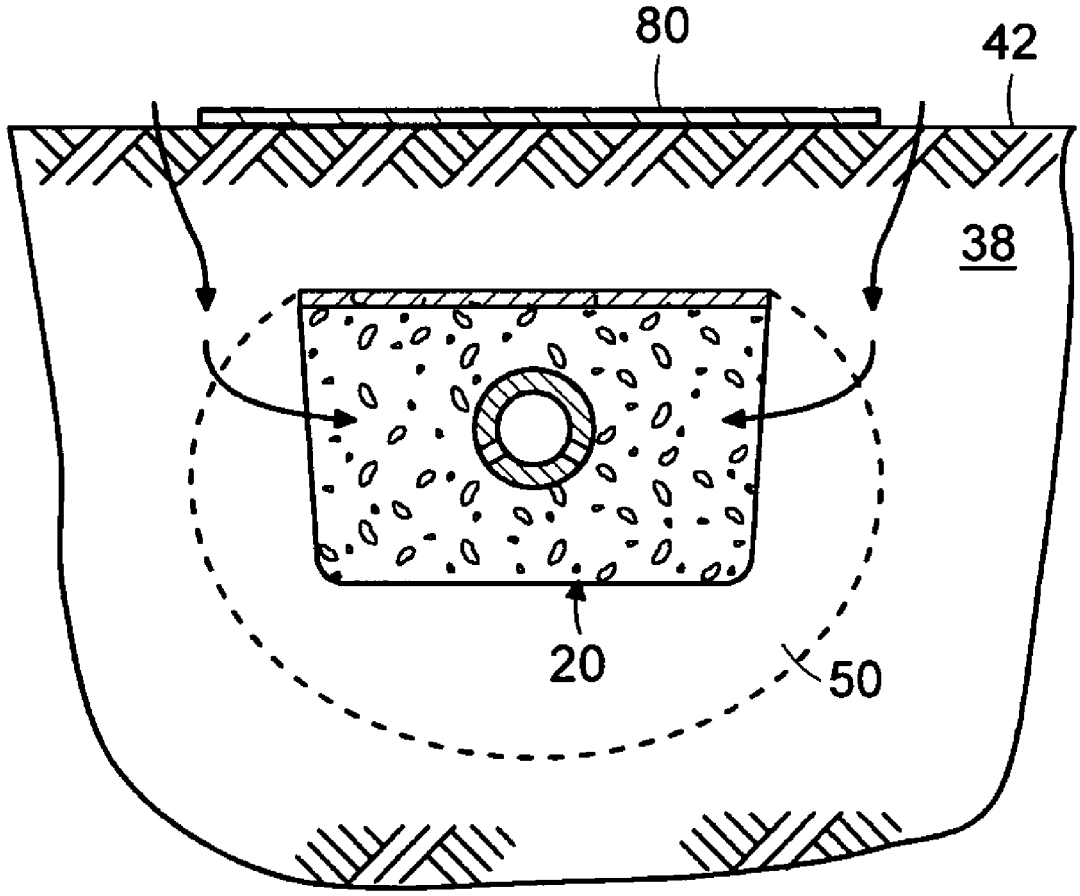
FIG. 5 is like FIG. 1, showing an air impermeable membrane on the soil surface.

FIG. 5 shows how an air impermeable membrane 80 such as polyethylene sheet is laid over the surface 42 of the soil proximately above the conduit. Adjacent areas are uncovered. Thus, air which is being drawn downwardly to replace water removed by the dewatering technique will flow as indicated by the arrows. With the membrane, air will be channeled to flow through soil near the sides of the conduit, rather than flowing directly downward through soil directly above the conduit. The membrane may be a sheet of plastic or granular media which is relatively impermeable, such as wetted bentonite. Other films and substances will be understood to be substitutional. The membrane may alternatively be buried beneath the surface, although that will usually only be practical with an original installation.

To facilitate flow of water through the soil of a leach field to a collection point when practicing the dewatering techniques described herein, the soil may be made more permeable by using a process wherein pressurized air or other fluids are forced into the earth through specially designed probes. For example, the commercially available Terra-Lift™ equipment and process (Terra Lift, Inc. Stockbridge, Mass., US) may be used, in accord with the description in U.S. Pat. No. 5,810,514. In the process, injection pipes are inserted into the depth of the soil, adjacent to the conduits. For instance, a pipe is inserted between parallel runs, at spaced apart locations, one after the other. The soil is lifted up and fractured by a sharp pulse of compressed air, and fissures or permeable paths are created within the soil. This aids flow of water away from the influence zone. Sometimes the process involves injection of beads or pellets into the fissures, but in practice of the present invention, that step will be mostly omitted.

The Terra Lift type process has been found useful for treating leach fields with saturated influence zones. However, a side effect is that after the injection pipe is removed, a hole is left in the soil. In the past this has not been considered of consequence, since from a human standpoint, the hole is relatively small in dimension. However, in the prior art practice, as water drains through the fissures to remote places, air from the surface preferentially flows down the hole, to fill the fissures and other spaces which were created by the process. Soil adjacent the fissures drains more slowly, over time by natural processes. In my improvement, any hole is sealed shortly after withdrawal of the probe. Thus, when water drains toward and from the fissures over time, air will be drawn generally downwardly through the soil, and not preferentially through the hole. Thus, the air diffusing through the soil will tend to induce movement of water from soil spaced apart from the fissures. In general, sealing of the hole induces better draining and restoration of the entirely of the leach field soil, particularly in the influence zone. The hole is sealed with tamped native soil, grouted with a material comprised of clay, Portland cement, sand bentonite, etc., or filled with expanding plastic foam, or by other known methods. Of course, the sealing of a hole makes for more effective air flowed into the field in practice of the LFA invention.

Any dewatering can be advantageous. How much dewatering will be achieved at any region within the influence zone will depend on the various factors, including degree of initial saturation, the character of the soil and any continuing inflows, the amount of time in which one of the techniques described herein is applied, and so forth. Moisture content of soil is typically defined in terms of the weight or volume percent water present compared to the maximum weight percent that could be contained. Here, moisture content refers to physically present water, compared to chemically combined water. See the further discussion below. Moisture content is best measured by simply drying a quantity (by gentle heating or evacuation) and measuring the weight change. Meters, including those based on electrical conductivity of soil, may be used. A preferred device for measuring volume percent water is an Aqua-Tel-TDR dielectric type moisture sensor (Automata, Inc., Nevada City, Calif., US).

In the invention, a saturated soil has by definition 100 percent moisture content and the same soil totally dry has zero percent. In soil which is saturated or near-saturated and is then drained, there will be a residual amount of water retained. That amount varies greatly with the character of the soil. For example, coarse sandy soils retain less water than fine loamy soils. That amount of water, measured by volume or weight according to know protocols, is referred to as field capacity. Variations in water content from the field capacity level are typically reported in terms of percent of field capacity. Thus, positive percentages reflect wetter soils and negative percentages reflect drier soils.

Quickly removing water, to reduce the moisture content, for example to 50%, means the spaces through out the soil that previously were occupied by water can now be occupied by air from the atmosphere. In the absence of other actions, and assuming minimal generation of other gases within the soil in view of the short time span, atmospheric air will occupy the spaces from which water was removed. This is per se good for an influence zone, insofar as waste water treatment is concerned. And, it is good in that it facilitates flowing of further air through the soil, as by means of a blower, because there is a lowering of the impedance or resistance to air flow. When the extent of dewatering is measured by determining moisture content, reducing the moisture content by about 10% by volume is substantial insofar as the practice of the invention and its effect on subsequent processing of waste water in an influence zone. Greater changes are of course desirable. Change in moisture content can also be characterized in terms of field capacity as the reference point, and it will be understood that an analogous number for substantial change will be derivable.

Of course, when determining the effectiveness of dewatering by measuring moisture content as a percentage, one considers a relevant local portion of the influence zone. When the processes of the invention are applied, as mentioned, it will be appreciated that a lesser effect will be realized on the portion of the influence zone which has an elevation lower than the elevation within the conduit to which water level could be lowered. Thus changes in moisture content, however characterized here, will be determined by measurement of a relevant sub-region or portion of the whole influence zone. For instance, a section of the influence zone which lies laterally to the conduit and above the conduit drain-down level would be a good sub-region to examine to determine the effectiveness of the invention.

While the invention is described in terms of soil of the earth, it will be understood that such term comprehends installations comprised in whole or part of artificial porous material such as sand and gravel and other particulate media, including filter beds.

Although this invention has been shown and described with respect to a preferred embodiment, it will be understood by those skilled in this art that various changes in form and detail thereof may be made without departing from the spirit and scope of the claimed invention.

What is claimed is:

1. A method of treating the leach field of a sewage system to improve its functioning, wherein the leach field is comprised of a septic tank in communication with a conduit buried within soil, which soil runs continuously from the conduit to an upper soil surface which is exposed to atmosphere, the conduit having an associated influence zone within the soil into which waste water flows and is acted upon biochemically to make the water more environmentally benign, which comprises: removing the water from said conduit while causing water to flow within the soil to the conduit, then reducing the pressure in the conduit to less than atmospheric pressure, to both further remove water and to cause inward flow of water from the influence zone into the conduit, while impeding vertically downward flow of atmospheric air that is induced by the step of reducing the pressure in the conduit, through that portion of the soil surface which lies directly above the conduit, while allowing downward flow of air in adjacent areas of the soil surface.

2. A method of treating the leach field of a sewage system to improve its functioning, wherein the leach field is comprised of a septic tank in communication with a conduit buried within soil, which soil runs continuously from the conduit to an upper soil surface which is exposed to atmosphere, the conduit having an associated influence zone within the soil into which waste water flows and is acted upon biochemically to make the water more environmentally benign, which comprises: removing the water from said conduit while causing water to flow within the soil to the conduit; and, then pressurizing the conduit with air or other active gas, to cause said air or other active gas to flow from the conduit into the influence zone, to substantially replace water in influence zone; and, removing a portion of the contents of the septic tank in contemporaneous cooperation with the removing of water from said conduit, before pressurizing the conduit.

3. A method of treating the leach field of a sewage system to improve its functioning, wherein the leach field is comprised of a conduit buried within soil, which soil runs continuously from the conduit to an upper soil surface which is exposed to atmosphere, the conduit having an associated influence zone within the soil into which waste water flows and is acted upon biochemically to make the water more environmentally benign, which comprises: inserting one or more vertical pipes into the soil from the surface thereof at a point or points spaced apart from the conduit, the pipes adapted to act as collection points, and to receive water at their lower ends causing water to flow within the soil to one or more collection points by removing water therefrom; and, then pressurizing the conduit with air or other active gas, to cause said air or other active gas to flow from the conduit into the influence zone, to substantially replace water in influence zone.

4. A method of treating the leach field of a sewage system to improve its functioning, wherein the leach field is comprised of a conduit buried within soil, which soil runs continuously from the conduit to an upper soil surface which is exposed to atmosphere, the conduit having an associated influence zone within the soil into which waste water flows and is acted upon biochemically to make the water more environmentally benign, which comprises:

inserting a pipe into the soil at a point spaced apart from the conduit, to thereby create a hole in the soil; and, injecting air or other gas into the soil at the point with pressure and volume sufficient to uplift or fragment the soil and to create passages for water within the soil:

removing the pipe from the soil and sealing said hole left by the pipe:

removing water from the interior of said conduit:

and pressurizing the interior of the conduit with air or other active gas, to cause said air or other active gas to flow from the conduit into the influence zone, to substantially replace water in influence zone.

* * * * *